US010368156B1

(12) United States Patent
Beckhart

(10) Patent No.: US 10,368,156 B1
(45) Date of Patent: Jul. 30, 2019

(54) CONFIGURABLE EARBUD RETENTION AND STABILIZATION SYSTEM

(71) Applicant: Gordon Haggott Beckhart, Colorado Springs, CO (US)

(72) Inventor: Gordon Haggott Beckhart, Colorado Springs, CO (US)

( * ) Notice: Subject to any disclaimer, the term of this patent is extended or adjusted under 35 U.S.C. 154(b) by 0 days.

(21) Appl. No.: 15/787,645

(22) Filed: Oct. 18, 2017

Related U.S. Application Data

(60) Provisional application No. 62/410,080, filed on Oct. 19, 2016.

(51) Int. Cl.
*H04R 1/10* (2006.01)

(52) U.S. Cl.
CPC ..... *H04R 1/105* (2013.01); *H04R 1/1016* (2013.01); *H04R 1/1058* (2013.01)

(58) Field of Classification Search
CPC .. H04R 1/1066; H04R 1/1016; H04R 5/0335; H04R 1/105; H04R 1/10
USPC ..... 381/370, 374, 376, 379, 380, 381, 383, 381/385
See application file for complete search history.

(56) References Cited

U.S. PATENT DOCUMENTS 6,186,362 B1 2/2001 Smith
2004/0213427 A1* 10/2004 Yoon ..... H04R 1/08 381/370
2006/0147078 A1* 7/2006 Neu ..... H04R 1/105 381/374
2008/0298622 A1 12/2008 Lee
2008/0310666 A1 12/2008 Wengreen
2009/0022352 A1 1/2009 Weibel
2009/0073950 A1 3/2009 Guccione et al.
2009/0123016 A1 5/2009 Rise
2009/0226024 A1 9/2009 Dean
2009/0285434 A1 11/2009 Williams et al.
2010/0124349 A1* 5/2010 Bass ..... H04R 1/10 381/379
2011/0170731 A1* 7/2011 Beckhart ..... H04R 1/105 381/381
2017/0282662 A1* 10/2017 North ..... B60G 7/005

* cited by examiner

*Primary Examiner* — Norman Yu
(74) *Attorney, Agent, or Firm* — The Law Office of Patrick F. O'Reilly III, LLC

(57) ABSTRACT

A configurable earbud retention and stabilization system is disclosed herein. The configurable earbud retention and stabilization system includes a bendable earloop configured to fit over an ear of a user, the bendable earloop having a first end and a second end oppositely disposed relative to the first end, the bendable earloop defining a clip aperture proximate to the first end, the bendable earloop configured to be deformed into a plurality of different positions so as to provide a customized fit for the user; and an earbud clip, the earbud clip forming a cavity configured to receive an earbud headphone therein, the earbud clip including a connecting member received within the clip aperture of the bendable earloop so as to detachably couple the earbud clip to the bendable earloop. In some embodiments, the bendable earloop includes an inner wire enabling the bendable earloop to be deformed into the different positions.

20 Claims, 8 Drawing Sheets

Section A-A

Section A-A

Section B-B

CONFIGURABLE EARBUD RETENTION AND STABILIZATION SYSTEM

CROSS-REFERENCE TO RELATED APPLICATIONS

This patent application claims priority to, and incorporates by reference in its entirety, U.S. Provisional Patent Application No. 62/410,080, entitled "Configurable Earbud Retention and Stabilization System", filed on Oct. 19, 2016.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

INCORPORATION BY REFERENCE OF MATERIAL SUBMITTED ON A COMPACT DISK

Not Applicable.

BACKGROUND OF THE INVENTION

1. Field of the Invention

The invention generally relates to a configurable earbud retention and stabilization system. More particularly, the invention relates to a configurable earbud retention and stabilization system that enables earbud headphones to be effectively retained on the ears of a user.

2. Background

Earbuds have become very common and popular over the past few years. Earbuds are speaker headsets where the speaker is small enough to fit inside the ear. Earbuds are supplied with many portable music players and with most cell phones. Earbuds are a good way to keep a cell phone and the potentially harmful electromagnetic radiation away from one's head. Unfortunately the one-size-fits-all approach to earbuds does not match the wide variety of ear shapes, sizes, and configurations.

Earbuds are especially troublesome if the user is active or moving. Jogging, biking, skiing, working out, or simply walking are all example activities that can cause earbuds to fall out. Sometimes just turning one's head can cause earbuds to come out. To prevent this, some users will push the earbuds further in their ear, leading to discomfort. Some folks will simply not use the free earbuds that come with their phone or music player if their earbuds fall out or are not comfortable.

Some earbuds do come with adapters, simply different sizes of rubber stoppers, meant to jam into different size ears. This works for some ears, but it is not the most comfortable solution. It is also not the best solution for all situations. For example, jogging along a road, you might want a looser fit to hear ambient noise, such as traffic noise.

Sport specific earbud headsets are available at a higher cost, especially considering the user probably already has a free set of earbuds with their device. Sport headsets do offer some better retention options, but still do not offer the full adjustability to set the earbud in a specific position that provides the desired comfort and sound quality.

New wireless earbuds are becoming available. These wireless earbuds have the same fit, comfort, and stability issues as the wired earbuds. Newer wireless earbuds also present the bigger issue of simple loss if an earbud falls out. With the high cost of these new wireless earbuds, loss is a significant issue.

Thus, there is a need for a fully configurable earbud stabilization system that is affordable, fits a user's current earbuds, and can be adjusted to and set-up for different ears and different situations.

BRIEF SUMMARY OF EMBODIMENTS OF THE INVENTION

Accordingly, the present invention is directed to a configurable earbud retention and stabilization system that substantially obviates one or more problems resulting from the limitations and deficiencies of the related art.

In accordance with one or more embodiments of the present invention, there is provided a configurable earbud retention and stabilization system, which includes a bendable earloop configured to fit over an ear of a user, the bendable earloop having a first end and a second end oppositely disposed relative to the first end, the bendable earloop defining a clip aperture proximate to the first end, the bendable earloop configured to be deformed into a plurality of different positions so as to provide a customized fit for the user; and an earbud clip, the earbud clip forming a cavity configured to receive an earbud headphone therein, the earbud clip including a connecting member received within the clip aperture of the bendable earloop so as to detachably couple the earbud clip to the bendable earloop.

In a further embodiment of the present invention, the bendable earloop comprises an outer body portion and an inner wire disposed within the outer body portion, the inner wire enabling the bendable earloop to be deformed into the plurality of different positions and to maintain a particular position selected by the user without flexing back into a predeformed position.

In yet a further embodiment, the inner wire of the bendable earloop comprises oppositely disposed bent ends, a first one of the oppositely disposed bent ends of the inner wire being disposed proximate to the first end of the bendable earloop, and a second one of the oppositely disposed bent ends of the inner wire being disposed proximate to the second end of the bendable earloop, the oppositely disposed bent ends of the inner wire facilitate the retention of the outer body portion on the inner wire and prevent sharp ends of the inner wire from protruding through the outer body portion.

In still a further embodiment, the clip aperture of the bendable earloop is in the form of a cylindrically-shaped through hole with a substantially constant diameter.

In yet a further embodiment, the clip aperture of the bendable earloop has a first aperture end proximate to the earbud clip and a second aperture end distal from the earbud clip, the first aperture end of the clip aperture being surrounded by a raised lip protruding from a side of the bendable earloop, the raised lip stabilizing the earbud clip on the bendable earloop.

In still a further embodiment, the earbud clip has a first concave side and a second convex side, the first concave side of the earbud clip defining the cavity configured to receive the earbud headphone, and the connecting member of the earbud clip extending from the second convex side of the earbud clip.

In yet a further embodiment, the connecting member of the earbud clip comprises a shaft portion and a cap portion, the shaft portion of the earbud clip having a first diameter that substantially corresponds to a diameter of the clip aperture of the bendable earloop, and the cap portion of the earbud clip having a second diameter that is greater than the diameter of the clip aperture, the shaft portion of the earbud clip received within the clip aperture of the bendable earloop, and the cap portion of the earbud clip retaining the earbud clip in engagement with the bendable earloop.

In still a further embodiment, the cap portion of the connecting member of the earbud clip comprises an outer hemispherical surface and an inner annular surface disposed opposite to the outer hemispherical surface, the inner annular surface of the cap portion abutting an outer side of the bendable earloop.

In yet a further embodiment, the connecting member of the earbud clip further comprises a tapered portion extending between the inner annular surface of the cap portion and the shaft portion of the connecting member.

In still a further embodiment, the earbud clip has a cylindrical portion configured to receive a stem portion of the earbud headphone, and a pair of oppositely disposed wing members configured to support a speaker portion of the earbud headphone.

In accordance with one or more other embodiments of the present invention, there is provided a configurable earbud retention and stabilization system, which includes a bendable earloop configured to fit over an ear of a user, the bendable earloop having a first end and a second end oppositely disposed relative to the first end, the bendable earloop including an outer body portion and an inner wire disposed within the outer body portion, the inner wire enabling the bendable earloop to be deformed into a plurality of different positions and to maintain a customized position selected by the user without flexing back into a predeformed position; and an earbud clip, the earbud clip forming a cavity configured to receive an earbud headphone therein, the earbud clip including a connecting member received within the clip aperture of the bendable earloop so as to detachably couple the earbud clip to the bendable earloop.

In a further embodiment of the present invention, the inner wire of the bendable earloop comprises oppositely disposed bent ends, a first one of the oppositely disposed bent ends of the inner wire being disposed proximate to the first end of the bendable earloop, and a second one of the oppositely disposed bent ends of the inner wire being disposed proximate to the second end of the bendable earloop, the oppositely disposed bent ends of the inner wire facilitate the retention of the outer body portion on the inner wire and prevent sharp ends of the inner wire from protruding through the outer body portion.

In yet a further embodiment, the clip aperture of the bendable earloop is in the form of a cylindrically-shaped through hole with a substantially constant diameter.

In still a further embodiment, the clip aperture of the bendable earloop has a first aperture end proximate to the earbud clip and a second aperture end distal from the earbud clip, the first aperture end of the clip aperture being surrounded by a raised lip protruding from a side of the bendable earloop, the raised lip stabilizing the earbud clip on the bendable earloop.

In yet a further embodiment, the earbud clip has a first concave side and a second convex side, the first concave side of the earbud clip defining the cavity configured to receive the earbud headphone, and the connecting member of the earbud clip extending from the second convex side of the earbud clip.

In still a further embodiment, the connecting member of the earbud clip comprises a shaft portion and a cap portion, the shaft portion of the earbud clip having a first diameter that substantially corresponds to a diameter of the clip aperture of the bendable earloop, and the cap portion of the earbud clip having a second diameter that is greater than the diameter of the clip aperture, the shaft portion of the earbud clip received within the clip aperture of the bendable earloop, and the cap portion of the earbud clip retaining the earbud clip in engagement with the bendable earloop.

In yet a further embodiment, the cap portion of the connecting member of the earbud clip comprises an outer hemispherical surface and an inner annular surface disposed opposite to the outer hemispherical surface, the inner annular surface of the cap portion abutting an outer side of the bendable earloop.

In still a further embodiment, the connecting member of the earbud clip further comprises a tapered portion extending between the inner annular surface of the cap portion and the shaft portion of the connecting member.

In yet a further embodiment, the earbud clip is configured to accommodate a wireless earbud headphone.

In still a further embodiment, the earbud clip is configured to accommodate a wire-type earbud headphone.

It is to be understood that the foregoing general description and the following detailed description of the present invention are merely exemplary and explanatory in nature. As such, the foregoing general description and the following detailed description of the invention should not be construed to limit the scope of the appended claims in any sense.

BRIEF DESCRIPTION OF THE SEVERAL VIEWS OF THE DRAWINGS

The invention will now be described, by way of example, with reference to the accompanying drawings, in which.

Throughout the figures, the same parts are always denoted using the same reference characters so that, as a general rule, they will only be described once.

DETAILED DESCRIPTION OF EMBODIMENTS OF THE INVENTION

Figure 1:
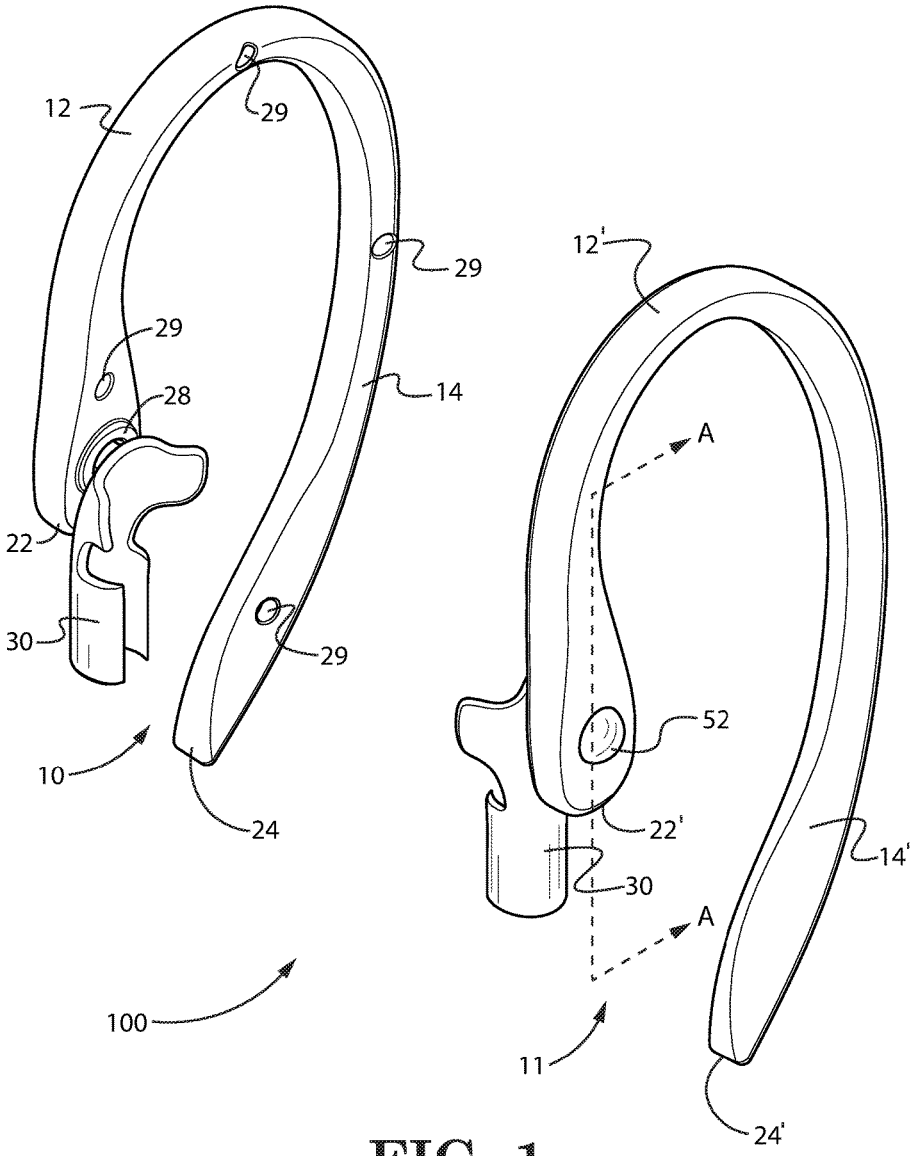
FIG. 1 is a perspective view of a configurable earbud retention and stabilization system, according to one embodiment of the invention.
Figure 2:
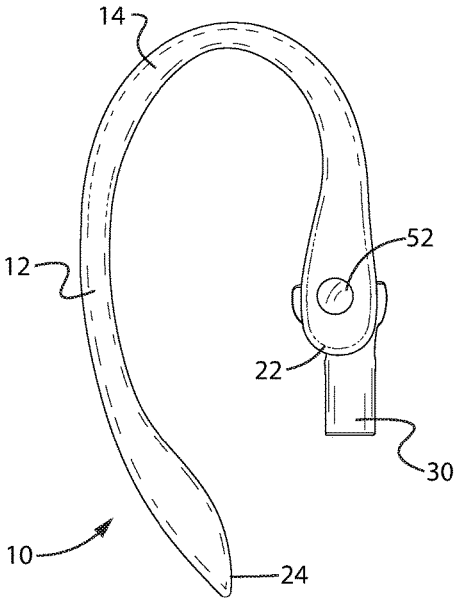
FIG. 2 is a front elevational view of the right earloop and clip assembly of the configurable earbud retention and stabilization system of FIG. 1.
Figure 3:
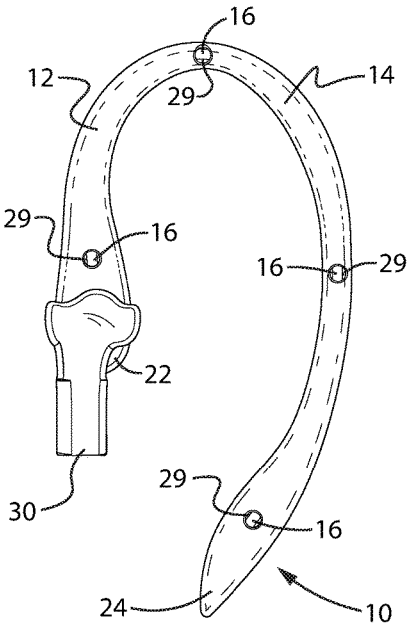
FIG. 3 is a rear elevational view of the right earloop and clip assembly of FIG. 2.
Figure 4:
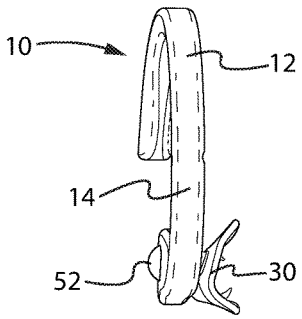
FIG. 4 is a top plan view of the right earloop and clip assembly of FIG. 2.
Figure 5:
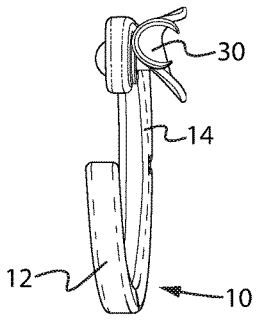
FIG. 5 is a bottom plan view of the right earloop and clip assembly of FIG. 2.

An illustrative embodiment of a configurable earbud retention and stabilization system is seen generally at 100 in FIG. 1. In the embodiment of FIG. 1, the configurable earbud retention and stabilization system 100 comprises a right earloop and clip assembly 10 and a left earloop and clip assembly 11. While the illustrative embodiment of FIG. 1 includes right and left earloop and clip assemblies 10, 11, it is to be understood that, in other embodiments, the configurable earbud retention and stabilization system may include a single earloop and clip assembly for supporting a single earbud headphone (i.e., either a right or left earbud headphone).

With combined reference to FIGS. 1-5, it can be seen that the right earloop and clip assembly 10 of the illustrative embodiment includes a bendable earloop 12 configured to fit over a right ear of a user. The bendable earloop 12 is generally C-shaped or spiral-shaped, and has a first end 22 and a second end 24 oppositely disposed relative to the first end 22. The bendable earloop 12 defines a clip aperture 26 proximate to the first end 22 (see FIG. 7). As will be explained in more detail hereinafter, the bendable earloop 12 is configured to be deformed into a plurality of different positions so as to provide a customized fit for the user. Referring again to FIGS. 1-5, it can be seen that the right earloop and clip assembly 10 further includes an earbud clip 30. The earbud clip 30 forms a cavity 34 configured to receive an earbud headphone therein (see FIG. 12). The earbud clip 30 includes a connecting member 50 received within the clip aperture 26 of the bendable earloop 12 so as to detachably couple the earbud clip 30 to the bendable earloop 12 (see FIG. 7).

Figure 10:
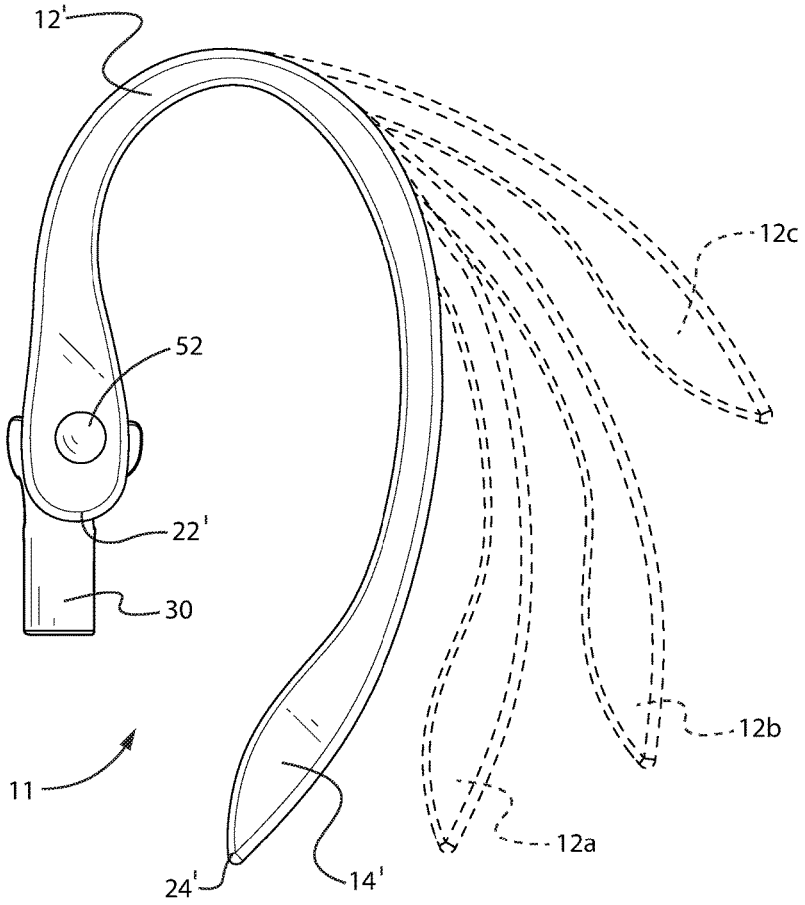
FIG. 10 is a front elevational view of the left earloop and clip assembly of the configurable earbud retention and stabilization system of FIG. 1, wherein the earloop is shown deformed into a plurality of different positions.

Similar to the right earloop and clip assembly 10, as shown in FIG. 1, the left earloop and clip assembly 11 of the illustrative embodiment includes a bendable earloop 12' configured to fit over a left ear of a user. The bendable earloop 12' is generally C-shaped or spiral-shaped, and has a first end 22' and a second end 24' oppositely disposed relative to the first end 22'. The bendable earloop 12' defines a clip aperture 26 proximate to the first end 22' (see FIGS. 6A and 6B). Like the bendable right earloop 12 described above, the bendable left earloop 12' is configured to be deformed into a plurality of different positions 12*a*, 12*b*, 12*c* (see FIG. 10) so as to provide a customized fit for the user. Referring again to FIG. 1, it can be seen that the left earloop and clip assembly 11 also includes an earbud clip 30 with a connecting member 50 received within the clip aperture 26 of the bendable earloop 12' so as to detachably couple the earbud clip 30 to the bendable earloop 12' (see FIGS. 6A and 6B).

Figure 7:
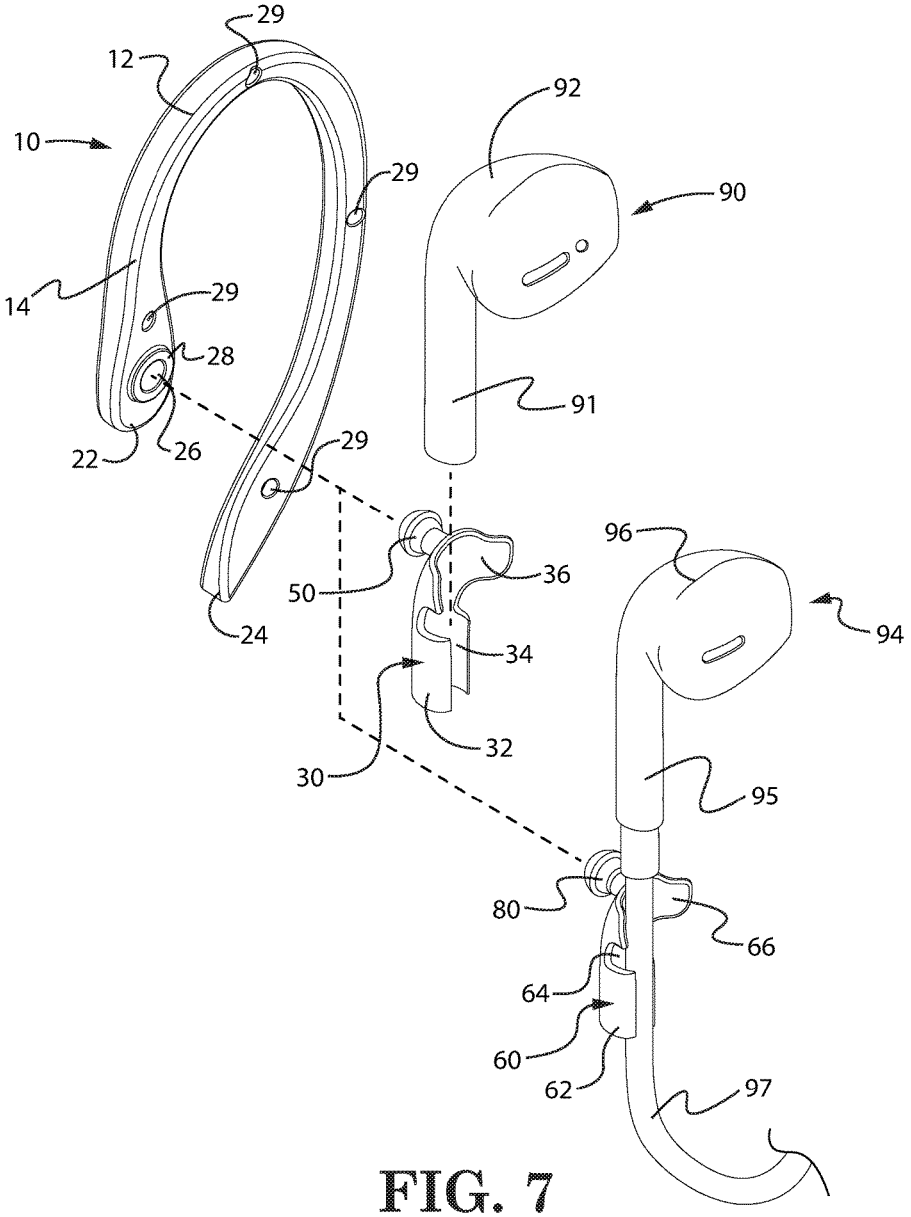
FIG. 7 is a perspective view of the right earloop of the configurable earbud retention and stabilization system of FIG. 1 depicted with a clip for retaining a wireless earbud headphone and another clip for retaining a wire-type earbud headphone, wherein the wireless and wire-type earbud headphones are shown being inserted into their respective clips.
Figure 8:
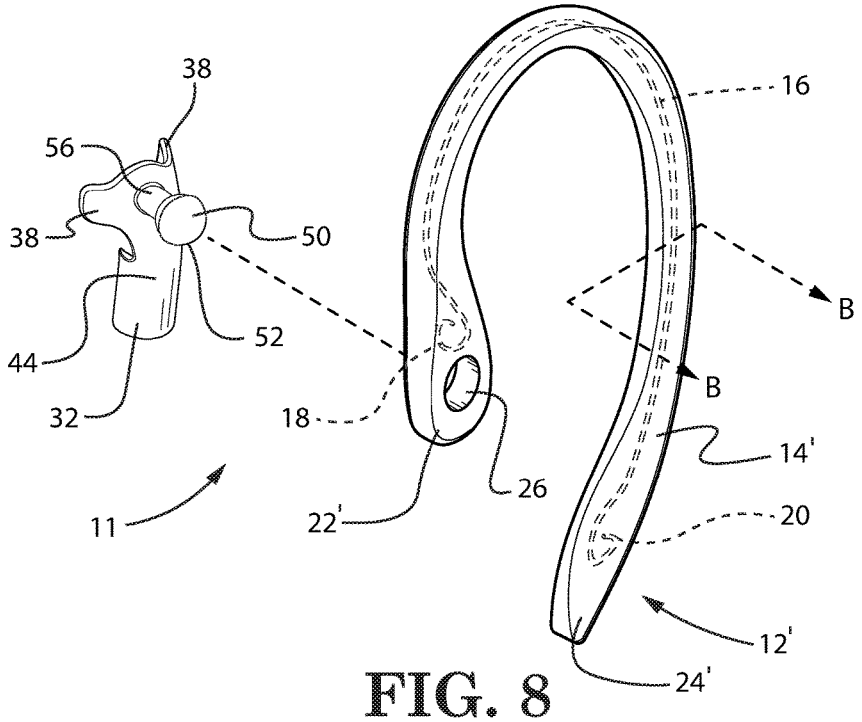
FIG. 8 is a perspective view of the left earloop and clip assembly of the configurable earbud retention and stabilization system of FIG. 1, wherein the clip is shown detached from the earloop.

Now, with reference primarily to FIGS. 1, 7, and 8, the structure of the right and left bendable earloops 12, 12' of the illustrative embodiment will be described in further detail. As shown in FIGS. 1, 7, and 8, each bendable earloop 12, 12' has an outer body portion 14, 14' and an inner wire 16 disposed within the outer body portion 14, 14'. The inner wire 16 enables the bendable earloop 12, 12' to be deformed into the plurality of different positions (e.g., the positions 12*a*, 12*b*, 12*c* in FIG. 10) and to maintain a particular position selected by the user without flexing back into a predeformed position. As shown in FIG. 8, the inner wire 16 of each bendable earloop 12, 12' comprises oppositely disposed bent ends 18, 20. A first one 18 of the oppositely disposed bent ends 18, 20 of the inner wire 16 is disposed proximate to the first end 22, 22' of the bendable earloop 12, 12', and a second one 20 of the oppositely disposed bent ends 18, 20 of the inner wire 16 is disposed proximate to the second end 24' of the bendable earloop 12, 12'. The oppositely disposed bent ends 18, 20 of the inner wire 16 facilitate the retention of the outer body portion 14, 14' on the inner wire 16 and prevent sharp ends of the inner wire 16 from protruding through the outer body portion 14, 14'.

In the illustrative embodiment, the earloop 12, 12' is molded with the internal bendable wire 16. The bent ends 18, 20 of the inner wire 16 help to ensure better adhesion within the over-molded rubber, and help to prevent sharp wires from protruding from the over-molded rubber. In an alternative embodiment, the wire ends could be melted into a bead shape or formed with rounded ends to prevent sharp ends.

Figure 9:
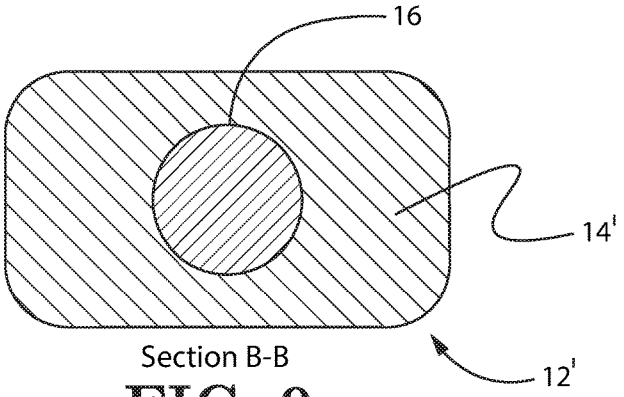
FIG. 9 is a transverse sectional view of the left earloop of FIG. 8, wherein the section is generally cut along the cutting-plane line B-B in FIG. 8.

In the illustrative embodiment, as shown in FIGS. 1, 3, 6A, and 7, the outer body portion 14, 14' of the bendable earloop 12, 12' is provided with a plurality of circumferentially spaced-apart cylindrical bores 29 therein (e.g., four (4) circumferentially spaced-apart cylindrical bores 29). In the illustrative embodiment, during the molding of the outer body portion 14, 14' of the bendable earloop 12, 12', the inner wire 16 of the bendable earloop 12, 12' is held in place by pins at the locations of the cylindrical bores 29, and the outer body portion 14, 14' is then molded over the inner wire 16. After the molding of the outer body portion 14, 14' is completed, the bendable earloop 12, 12' is detached from the pins, and the outer body portion 14, 14' has the cylindrical bores 29 in the prior locations of the pins. A cross-section view of the inner wire 16 disposed within the outer body portion 14' is shown in FIG. 9.

Advantageously, the embedded bendable wire 16 of the bendable earloop 12, 12' allows full bend customization around the ear of the user. The embedded bendable wire 16 can also bend in toward the ear or away from the ear. That is, the bendable shape of the earloops 12, 12' advantageously allows the earloops 12, 12' to be adjustable in the z-direction (i.e., the direction toward or away from ear) for comfort and sound level control. The embedded bendable wire 16 can also bend forward or backward. The embedded bendable wire 16 thus allows the user to adjust and set the placement of the earbud headphone within his or her ear by bending the wire 16 to the desired position.

In one example embodiment, the user can configure the earbud headphone to stay slightly away from the ear canal. An example case would be the desire to hear external sounds, such as jogging or biking next to a road, where the user wants to hear ambient sounds including oncoming traffic. In another example, a user can bend the earloop 12, 12' to hold the earbud headphone more deeply in the ear. An example case would be an airplane with loud background noise, and the user desires a tighter fit to minimize external airplane sounds.

Figure 6A:
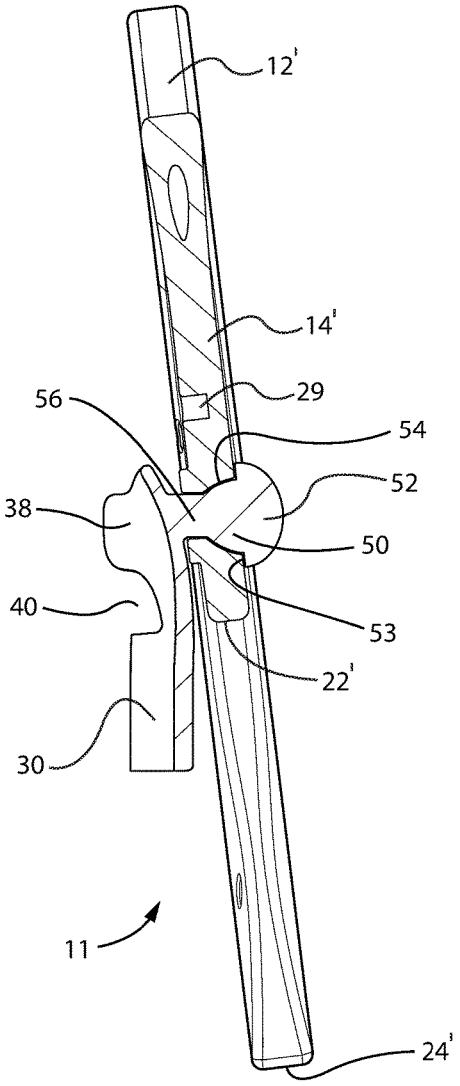
FIG. 6A is a longitudinal sectional view of the left earloop and clip assembly of the configurable earbud retention and stabilization system of FIG. 1, wherein the section is generally cut along the cutting-plane line A-A in FIG. 1.
Figure 6B:
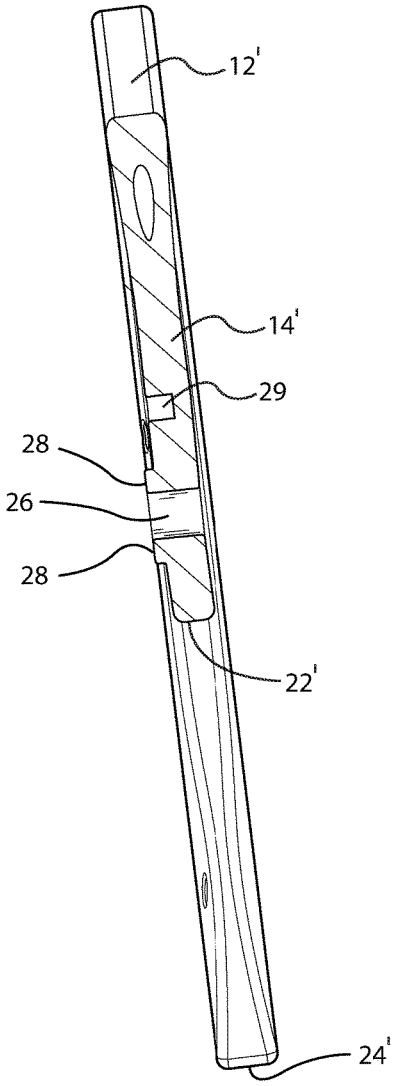
FIG. 6B is another longitudinal sectional view cut through the left earloop similar to that of FIG. 6A, except with the clip removed from the earloop.

As shown in FIGS. 6B and 8, the clip aperture 26 of each bendable earloop 12, 12' of the illustrative embodiment is in the form of a cylindrically-shaped through hole with a substantially constant diameter or constant diameter. In the illustrative embodiment, the sidewall of the clip aperture 26 is straight in the longitudinal direction of the aperture 26 in its undeformed state (i.e., the undeformed state illustrated in FIG. 6B), and is not in the form of a socket. As such, the clip aperture 26 of the illustrative embodiment is easier to form than a socket configuration. As best illustrated in the sectional view of FIG. 6A, the clip aperture 26 of each bendable earloop 12, 12' has a first aperture end proximate to the earbud clip 30 and a second aperture end distal from the earbud clip 30. The first aperture end of the clip aperture 26 is surrounded by a raised lip 28 protruding from a side of the bendable earloop 12, 12' (refer to FIGS. 1, 6B, and 7). Advantageously, the raised lip 28 stabilizes the earbud clip 30 on the bendable earloop 12, 12' (i.e., the raised lip 28 prevents the earbud clip 30 from rocking back and forth, etc.). Advantageously, the stand-off lip 28 maintains the desired gap between the convex side 44 of the earbud clip 30 and the inner side of the earloop 12, 12'.

In the illustrative embodiment, the outer body portion 14, 14' of each bendable earloop 12, 12' may be formed from a suitable flexible polymeric material or plastic, such as silicone. In the illustrative embodiment, the inner wire 16 of each bendable earloop 12, 12' may be formed from a suitable metallic material or metal that is bendable by a user.

Figure 12:
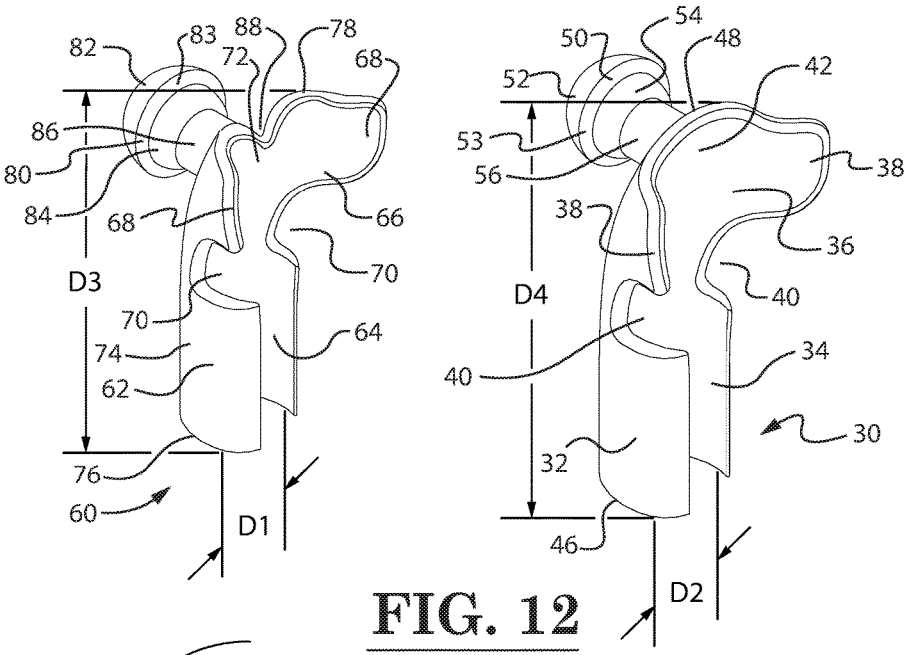
FIG. 12 illustrates a clip for wire-type earbud headphone and a clip for a wireless earbud headphone, according to embodiments of the invention.
Figure 13:
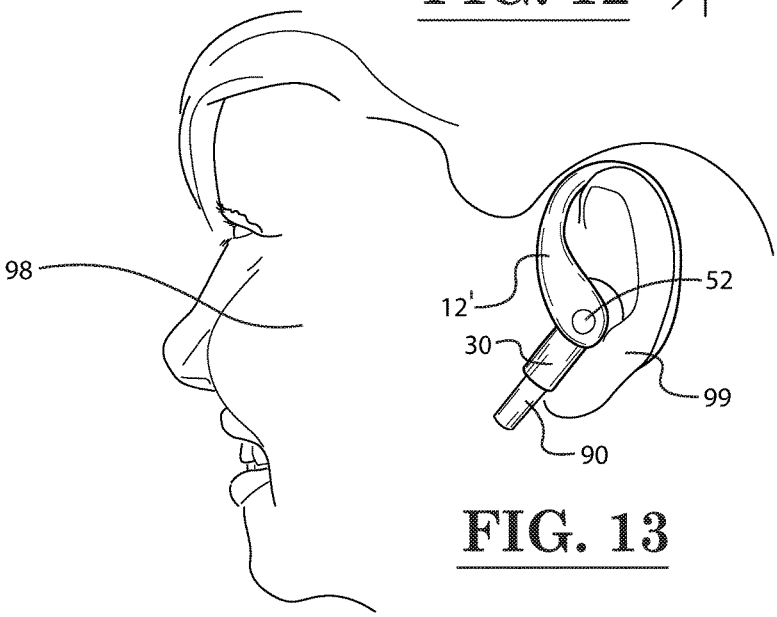
FIG. 13 illustrates a left earloop and clip assembly of the configurable earbud retention and stabilization system of FIG. 1 being used to retain a wireless earbud headphone in the ear of a user.

Next, referring primarily to FIGS. 6A, 7, 8, and 12, the structure of a first type of earbud clip of the illustrative embodiment will be described in detail. In the illustrative embodiment, the first type of earbud clip (i.e., earbud clip 30) is configured to accommodate a wireless earbud headphone 90 (e.g., as shown in FIGS. 7 and 13) being worn by a user (e.g., worn in a left ear 99 of a user 98). With combined reference to FIGS. 8 and 12, it can be seen that the earbud clip 30 has a first concave side 42 and a second convex side 44. The first concave side 42 of the earbud clip 30 defines the cavity 34 configured to receive the wireless earbud headphone (see FIG. 12), and the connecting member 50 of the earbud clip 30 extends from the second convex side 44 of the earbud clip 30 (see FIG. 8). Also, as illustrated in FIGS. 8 and 12, the connecting member 50 of the earbud clip 30 comprises a shaft portion 56 and a cap portion 52. The shaft portion 56 of the earbud clip 30 has a first diameter that substantially corresponds or corresponds to a diameter of the clip aperture 26 of the bendable earloop 12, 12', and the cap portion 52 of the earbud clip 30 has a second diameter that is greater than the diameter of the clip aperture 26 (refer to FIGS. 6A and 8). As best shown in the sectional view of FIG. 6A, the shaft portion 56 of the earbud clip 30 is received within the clip aperture 26 of the bendable earloop 12', and the cap portion 52 of the earbud clip 30 retains the earbud clip 30 in engagement with the bendable earloop 12'. In the illustrative embodiment, the connecting member 50 does not include any type of ball, but rather a generally mushroom-shaped connector that only permits single degree of freedom movement relative to the earloop 12, 12'.

Referring collectively to FIGS. 6A, 8, and 12, it can be seen that the cap portion 52 of the connecting member 50 of the earbud clip 30 comprises an outer hemispherical surface and an inner annular surface 53 disposed opposite to the outer hemispherical surface. The inner annular surface 53 of the cap portion 52 abuts an outer side of the bendable earloop 12' (as shown in the sectional view of FIG. 6A). Also, as best shown in FIGS. 6A and 12, the connecting member 50 of the earbud clip 30 further comprises a tapered curved portion 54 extending between the inner annular surface 53 of the cap portion 52 and the shaft portion 56 of the connecting member 50. As shown in FIG. 6A, the tapered curved portion 54 of the connecting member 50 outwardly deforms the clip aperture 26 when the clip 30 is engaged with the earloop 12'.

Turning again to FIGS. 7 and 12, it can be seen that the earbud clip 30 has a cylindrical portion 32 configured to receive a stem portion 91 of the wireless earbud headphone 90 (see FIG. 7), and a speaker receiving portion 36 with a pair of oppositely disposed wing members 38 configured to support a speaker portion 92 of the wireless earbud headphone 90 (see FIG. 7). As best shown in FIG. 12, the oppositely disposed wing members 38 of the speaker receiving portion 36 of the earbud clip 30 are separated from the cylindrical portion 32 of the earbud clip 30 by oppositely disposed notches 40. Also, as shown in FIG. 12, the earbud clip 30 has a first end 46 and a second end 48 oppositely disposed relative to the first end 46. The cylindrical portion 32 of the earbud clip 30 is at the first end 46 of the clip 30, while the speaker receiving portion 36 is at the second end 48 of the clip 30.

Figure 11:
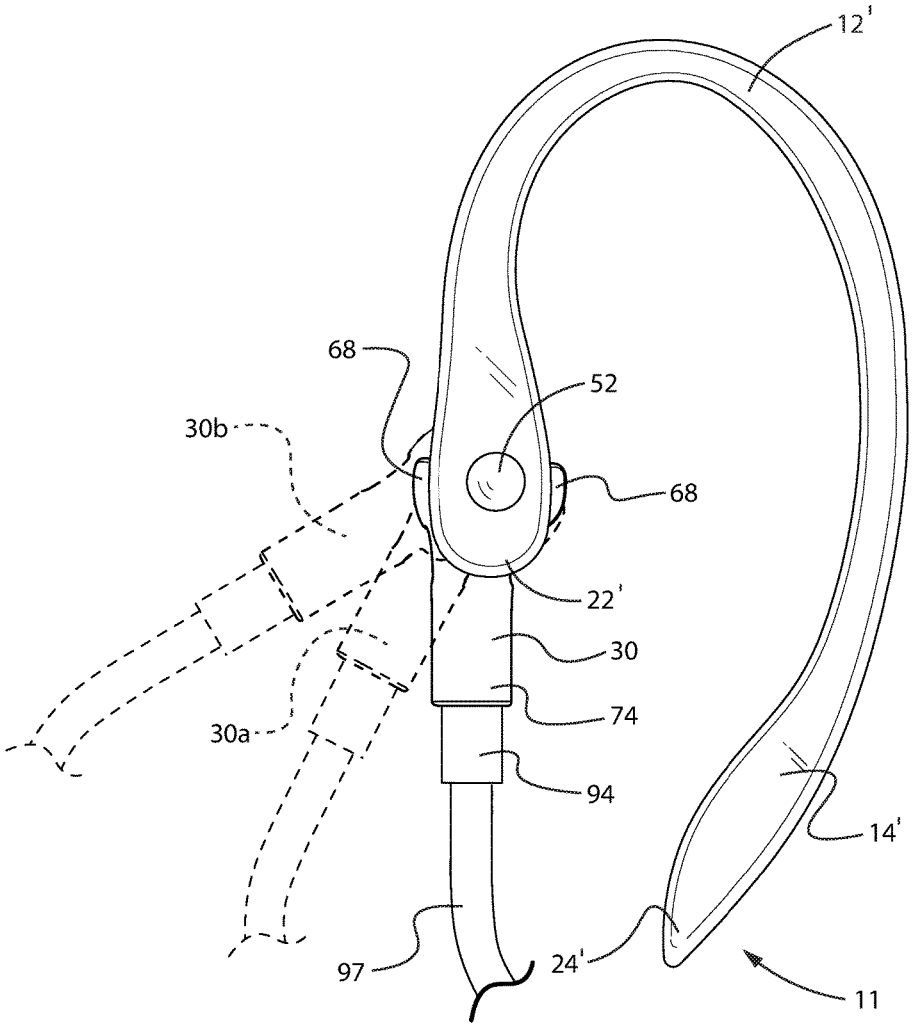
FIG. 11 is a front elevational view illustrating a left earloop and clip assembly supporting a wire-type earbud headphone therein, wherein the clip and wire-type earbud headphone is shown displaced into a plurality of different positions.

As shown in FIG. 11, when the connecting member 50 of the earbud clip 30 is received within the clip aperture 26 of the bendable earloop 12', the earbud clip 30 is rotatable relative to the bendable earloop 12' about an axis of rotation passing through the center of the cap portion 52 and extending longitudinally through the connector member 50 so as to enable one degree of freedom rotation about the axis of rotation (i.e., 360 degree rotation about the axis of rotation). In the illustrative embodiment, the earbud clip 30 does not have any degrees of freedom relative to the bendable earloop 12' other than the aforedescribed single degree of freedom rotation, and which is illustrated in FIG. 11. In FIG. 11, it can be seen that the rotational adjustment of the earbud clip 30 relative to the bendable earloop 12' allows the earbud clip 30 to assume a plurality of different positions 30*a*, 30*b* so as to provide a customized fit for the user. In the illustrative embodiment, the clip aperture 26 of the bendable earloop 12' is not in the form of a socket and the connecting member 50 of the earbud clip 30 is not in the form of a ball. As such, in the illustrative embodiment, the earbud clip 30 is not connected to the bendable earloop 12' by means of a ball and socket arrangement. The mushroom-shaped connector 50 of the earbud clip 30 engages the clip aperture 26 of the bendable earloop 12, 12' in a more secure manner than that of a ball and socket arrangement because the mushroom-shaped connector 50 of the earbud clip 30 is less susceptible to becoming inadvertently disengaged from the clip aperture 26 of the bendable earloop 12, 12'.

A second type of earbud clip of the illustrative embodiment will now be described with reference to FIGS. 7 and 12. Referring to these figures, it can be seen that, in many respects, the second type of earbud clip is similar to that of the first type described above. Moreover, many elements are common to both such types of earbud clips. For the sake of brevity, the elements that the second type of earbud clip has in common with the first type of earbud clip will not be discussed in detail because these elements have already been described above.

Unlike the earbud clip 30 described above, the second type of earbud clip (i.e., earbud clip 60) of the illustrative embodiment is configured to accommodate a wire-type earbud headphone 94 (e.g., as shown in FIG. 7) being worn by a user. With reference to FIG. 12, it can be seen that, similar to the earbud clip 30, the earbud clip 60 has a first concave side 72 and a second convex side 74. The first concave side 72 of the earbud clip 60 defines the cavity 64 configured to receive the wire-type earbud headphone 94 (see FIG. 7), and the connecting member 80 of the earbud clip 60 extends from the second convex side 74 of the earbud clip 60 (see FIG. 12). Also, as illustrated in FIGS. 7 and 12, the connecting member 80 of the earbud clip 60 comprises a shaft portion 86 and a cap portion 82. The shaft portion 86 of the earbud clip 60 has a first diameter that substantially corresponds or corresponds to a diameter of the clip aperture 26 of the bendable earloop 12, 12', and the cap portion 82 of the earbud clip 60 has a second diameter that is greater than the diameter of the clip aperture 26. Similar to that described above for the earbud clip 30, the shaft portion 86 of the earbud clip 60 is received within the clip aperture 26 of the bendable earloop 12', and the cap portion 82 of the earbud clip 60 retains the earbud clip 60 in engagement with the bendable earloop 12, 12'. In the illustrative embodiment, the connecting member 80 does not include any type of ball, but rather a generally mushroom-shaped connector that only permits single degree of freedom movement relative to the earloop 12, 12' (as shown in FIG. 11).

Referring to FIG. 12, like the earbud clip 30 described above, it can be seen that the cap portion 82 of the connecting member 80 of the earbud clip 60 comprises an outer hemispherical surface and an inner annular surface 83 disposed opposite to the outer hemispherical surface. The inner annular surface 83 of the cap portion 82 abuts an outer side of the bendable earloop 12, 12'. Also, as best shown in FIG. 12, the connecting member 80 of the earbud clip 60 further comprises a tapered curved portion 84 extending between the inner annular surface 83 of the cap portion 82 and the shaft portion 86 of the connecting member 80.

Turning again to FIGS. 7 and 12, it can be seen that the earbud clip 60 has a cylindrical portion 62 configured to receive a stem portion 95 with speaker wire 97 of the wire-type earbud headphone 94 (see FIG. 7), and a speaker receiving portion 66 with a pair of oppositely disposed wing members 68 configured to support a speaker portion 96 of the wire-type earbud headphone 94 (see FIG. 7). As best shown in FIG. 12, the oppositely disposed wing members 68 of the speaker receiving portion 66 of the earbud clip 60 are separated from the cylindrical portion 62 of the earbud clip 60 by oppositely disposed notches 70. Also, as shown in FIG. 12, the earbud clip 60 has a first end 76 and a second end 78 oppositely disposed relative to the first end 76. The cylindrical portion 62 of the earbud clip 60 is at the first end 76 of the clip 60, while the speaker receiving portion 66 is at the second end 78 of the clip 60. As shown in FIG. 12, a V-shaped notch 88 separates the oppositely disposed wing members 68 at the upper second end 78 of the clip 60.

Similar to that described above for the earbud clip 30, when the connecting member 80 of the earbud clip 60 is received within the clip aperture 26 of the bendable earloop 12, 12', the earbud clip 60 is rotatable relative to the bendable earloop 12, 12' about an axis of rotation passing through the center of the cap portion 82 and extending longitudinally through the connector member 80 so as to enable one degree of freedom rotation about the axis of rotation. In the illustrative embodiment, the earbud clip 60 does not have any degrees of freedom relative to the bendable earloop 12, 12' other than the aforedescribed single degree of freedom rotation.

Referring again to the illustrative embodiment of FIG. 12, it can be seen that the cylindrical portion 62 of the earbud clip 60 has a first inner diameter D1, while the cylindrical portion 32 of the earbud clip 30 has a second inner diameter D2. In the illustrative embodiment, the second inner diameter D2 of the cylindrical portion 32 of the earbud clip 30 for the wireless earbud headphone 90 is greater than the first inner diameter D1 of the cylindrical portion 62 of the earbud clip 60 for the wire-type earbud headphone 94 so as to accommodate the larger outer diameter of the stem portion 91 of the wireless earbud headphone 90 as compared to the stem portion 95 wire-type earbud headphone 94. Also, as shown in the illustrative embodiment of FIG. 12, it can be seen that the earbud clip 60 has an overall height D3, while the earbud clip 30 has an overall height D4. In the illustrative embodiment, the overall height D4 of the earbud clip 30 for the wireless earbud headphone 90 is slightly greater than the overall height D3 of the earbud clip 60 for the wire-type earbud headphone 94.

In the illustrative embodiment, each earbud clip 30, 60 may be formed from a suitable polymeric material or plastic that is able to be elastically deformed when the earbud headphone is snapped into place.

Advantageously, the aforedescribed configurable earbud retention and stabilization system 100 allows users to create a fully custom fit for their earbud headphones utilizing a bendable earloop and clip system. A user simply snaps in their earbud headphones into the clips, tilts and rotates the earbud headphones to comfortably fit one's ear angles, and bends the earloop 12, 12' to fit around their ear, and bends the earloop 12, 12' to set a distance in or out of the ear depending on preference and comfort. Because the configurable earbud retention and stabilization system 100 enables a user to attach their existing earbud headphones to the clips, the system 100 provides the user with a very cost effective solution because the user does not have to buy a new electronic headset.

In an alternative embodiment, the wall of the cylindrical portion 32 of the earbud clip 30 may extend completely around (i.e., 360 degrees) so that a wireless earbud headphone may slide into the top end of the cylindrical portion 32 of the earbud clip 30. Wireless earbud headphones are much more expensive than wired earbud headphones, and are much more susceptible to loss if an earbud falls out. In an example embodiment, a wireless earbud headphone is held in the ear for comfort and sound quality, as well as simply preventing loss.

In another alternative embodiment, the wired or wireless earbud headphones may have a retaining cord attaching to or near the earbud clip. In this alternative embodiment, the retaining cord allows the earbud headphones to hang from a user's neck when not in the ears. In one example embodiment, a retaining cord could connect between two wireless earbud headphones. In another example embodiment, a retaining cord could connect to a wireless earbud headphone at each end of the cord. In another example embodiment, a retaining cord could wrap around the back of a user's neck to provide light support and loss prevention for the two earbud headphones.

In yet another alternative embodiment, the earbud headphones may be manufactured with the earbud stabilization system built in. In still another alternative embodiment, the earbud is built with a connection member for the bendable earloop to connect with. In yet another alternative embodiment, the earbud headphone is manufactured with a built-in bendable earloop that provides adjustability to create and set the desired earloop shape and position of the earbud headphone.

In still another alternative embodiment, the configurable earbud retention and stabilization system 100 may be used for other applications. For example, the configurable earbud retention and stabilization system 100 may be used with sound deadening or earplug type of devices. The earplug portion may be made with a connector member that connects to a bendable earloop. In addition, the configurable earbud retention and stabilization system 100 may be used with ear warming devices or wind blocking devices, as many individuals are bothered by wind in the ears.

Any of the features or attributes of the above described embodiments and variations can be used in combination with any of the other features and attributes of the above described embodiments and variations as desired.

Although the invention has been shown and described with respect to a certain embodiment or embodiments, it is apparent that this invention can be embodied in many different forms and that many other modifications and variations are possible without departing from the spirit and scope of this invention.

Moreover, while exemplary embodiments have been described herein, one of ordinary skill in the art will readily appreciate that the exemplary embodiments set forth above are merely illustrative in nature and should not be construed as to limit the claims in any manner. Rather, the scope of the invention is defined only by the appended claims and their equivalents, and not, by the preceding description.

The invention claimed is:

1. A configurable earbud retention and stabilization system, comprising:

a bendable earloop configured to fit over an ear of a user, the bendable earloop having a first end and a second end oppositely disposed relative to the first end, the bendable earloop defining a clip aperture proximate to the first end, the bendable earloop configured to be deformed into a plurality of different positions so as to provide a customized fit for the user; and an earbud clip, the earbud clip forming a cavity configured to receive an earbud headphone therein, the earbud clip including a connecting member received within the clip aperture of the bendable earloop so as to detachably couple the earbud clip to the bendable earloop, the connecting member of the earbud clip comprising a shaft portion and a cap portion, the shaft portion of the earbud clip received within the clip aperture of the bendable earloop, and the cap portion of the earbud clip retaining the earbud clip in engagement with the bendable earloop while restricting the earbud clip to rotation about a single rotational axis which extends longitudinally through the connector member.

2. The configurable earbud retention and stabilization system according to claim 1, wherein the bendable earloop comprises an outer body portion and an inner wire disposed within the outer body portion, the inner wire enabling the bendable earloop to be deformed into the plurality of different positions and to maintain a particular position selected by the user without flexing back into a predeformed position.

3. The configurable earbud retention and stabilization system according to claim 2, wherein the inner wire of the bendable earloop comprises oppositely disposed bent ends, a first one of the oppositely disposed bent ends of the inner wire being disposed proximate to the first end of the bendable earloop, and a second one of the oppositely disposed bent ends of the inner wire being disposed proximate to the second end of the bendable earloop, the oppositely disposed bent ends of the inner wire facilitate the retention of the outer body portion on the inner wire and prevent sharp ends of the inner wire from protruding through the outer body portion.

4. The configurable earbud retention and stabilization system according to claim 1, wherein the clip aperture of the bendable earloop is in the form of a cylindrically-shaped through hole with a substantially constant diameter.

5. The configurable earbud retention and stabilization system according to claim 1, wherein the clip aperture of the bendable earloop has a first aperture end proximate to the earbud clip and a second aperture end distal from the earbud clip, the first aperture end of the clip aperture being surrounded by a raised lip protruding from a side of the bendable earloop, the raised lip stabilizing the earbud clip on the bendable earloop.

6. The configurable earbud retention and stabilization system according to claim 1, wherein the earbud clip has a first concave side and a second convex side, the first concave side of the earbud clip defining the cavity configured to receive the earbud headphone, and the connecting member of the earbud clip extending from the second convex side of the earbud clip.

7. The configurable earbud retention and stabilization system according to claim 1, wherein the shaft portion of the earbud clip has a first diameter that substantially corresponds to a diameter of the clip aperture of the bendable earloop, and the cap portion of the earbud clip has a second diameter that is greater than the diameter of the clip aperture.

8. The configurable earbud retention and stabilization system according to claim 7, wherein the cap portion of the connecting member of the earbud clip comprises an outer hemispherical surface and an inner annular flat surface disposed opposite to the outer hemispherical surface, the inner annular flat surface of the cap portion abutting an outer side of the bendable earloop.

9. The configurable earbud retention and stabilization system according to claim 8, wherein the connecting member of the earbud clip further comprises a tapered portion extending between the inner annular flat surface of the cap portion and the shaft portion of the connecting member.

10. The configurable earbud retention and stabilization system according to claim 1, wherein the earbud clip has a cylindrical portion configured to receive a stem portion of the earbud headphone, and a pair of oppositely disposed wing members configured to support a speaker portion of the earbud headphone.

11. A configurable earbud retention and stabilization system, comprising:

a bendable earloop configured to fit over an ear of a user, the bendable earloop having a first end and a second end oppositely disposed relative to the first end, the bendable earloop defining a clip aperture proximate to the first end, the bendable earloop including an outer body portion and an inner wire disposed within the outer body portion, the inner wire enabling the bendable earloop to be deformed into a plurality of different positions and to maintain a customized position selected by the user without flexing back into a pre-deformed position; and an earbud clip, the earbud clip forming a cavity configured to receive an earbud headphone therein, the earbud clip including a connecting member received within the clip aperture of the bendable earloop so as to detachably couple the earbud clip to the bendable earloop, the connecting member of the earbud clip comprising a shaft portion and a cap portion, the shaft portion of the earbud clip received within the clip aperture of the bendable earloop, and the cap portion of the earbud clip retaining the earbud clip in engagement with the bendable earloop while restricting the earbud clip to rotation about a single rotational axis which extends longitudinally through the connector member.

12. The configurable earbud retention and stabilization system according to claim 11, wherein the inner wire of the bendable earloop comprises oppositely disposed bent ends, a first one of the oppositely disposed bent ends of the inner wire being disposed proximate to the first end of the bendable earloop, and a second one of the oppositely disposed bent ends of the inner wire being disposed proximate to the second end of the bendable earloop, the oppositely disposed bent ends of the inner wire facilitate the retention of the outer body portion on the inner wire and prevent sharp ends of the inner wire from protruding through the outer body portion.

13. The configurable earbud retention and stabilization system according to claim 11, wherein the clip aperture of the bendable earloop is in the form of a cylindrically-shaped through hole with a substantially constant diameter.

14. The configurable earbud retention and stabilization system according to claim 11, wherein the clip aperture of the bendable earloop has a first aperture end proximate to the earbud clip and a second aperture end distal from the earbud clip, the first aperture end of the clip aperture being surrounded by a raised lip protruding from a side of the bendable earloop, the raised lip stabilizing the earbud clip on the bendable earloop.

15. The configurable earbud retention and stabilization system according to claim 11, wherein the earbud clip has a first concave side and a second convex side, the first concave side of the earbud clip defining the cavity configured to receive the earbud headphone, and the connecting member of the earbud clip extending from the second convex side of the earbud clip.

16. The configurable earbud retention and stabilization system according to claim 11, wherein the shaft portion of the earbud clip has a first diameter that substantially corresponds to a diameter of the clip aperture of the bendable earloop, and the cap portion of the earbud clip has a second diameter that is greater than the diameter of the clip aperture.

17. The configurable earbud retention and stabilization system according to claim 16, wherein the cap portion of the connecting member of the earbud clip comprises an outer hemispherical surface and an inner annular flat surface disposed opposite to the outer hemispherical surface, the inner annular flat surface of the cap portion abutting an outer side of the bendable earloop.

18. The configurable earbud retention and stabilization system according to claim 17, wherein the connecting member of the earbud clip further comprises a tapered portion extending between the inner annular flat surface of the cap portion and the shaft portion of the connecting member.

19. The configurable earbud retention and stabilization system according to claim 11, wherein the earbud clip is configured to accommodate a wireless earbud headphone.

20. The configurable earbud retention and stabilization system according to claim 11, wherein the earbud clip is configured to accommodate a wire-type earbud headphone.

* * * * *